United States Patent [19]

Hanaoka

[11] 4,075,837

[45] Feb. 28, 1978

[54] EXHAUST GAS PURIFYING SYSTEM FOR AN INTERNAL COMBUSTION ENGINE

[75] Inventor: Masanori Hanaoka, Toyoda, Japan

[73] Assignee: Toyota Jidosha Kogyo Kabushiki Kaisha, Toyota, Japan

[21] Appl. No.: 723,289

[22] Filed: Sep. 14, 1976

Related U.S. Application Data

[63] Continuation-in-part of Ser. No. 622,975, Oct. 16, 1975, abandoned.

[30] Foreign Application Priority Data

Jun. 18, 1975 Japan ..... 50-74178

[51] Int. Cl.[2] ..... F02B 75/10

[52] U.S. Cl. ..... 60/282; 60/307; 123/97 B; 123/119 EC; 123/127; 123/198 F

[58] Field of Search ..... 60/282, 274, 285, 307, 60/284; 123/119 EC, 119 R, 198 F, 97 B, 127

[56] References Cited

U.S. PATENT DOCUMENTS

| | | | |
|---|---|---|---|
| 1,960,432 | 5/1934 | Barker | 123/97 B |
| 2,623,617 | 12/1952 | Snyder | 123/198 F |
| 3,192,706 | 7/1965 | Dolza | 60/307 |
| 3,270,724 | 9/1966 | Dolza | 123/198 F |
| 3,698,371 | 10/1972 | Mitsuyama | 123/198 F |
| 3,800,772 | 4/1974 | Gospodar | 60/307 |
| 3,861,366 | 1/1975 | Masaki | 123/119 EC |
| 3,906,910 | 9/1975 | Szlaga | 123/97 B |
| 3,921,612 | 11/1975 | Aono | 123/119 EC |

*Primary Examiner*—Douglas Hart
*Attorney, Agent, or Firm*—Stevens, Davis, Miller & Mosher

[57] ABSTRACT

Disclosed is an improved exhaust gas purifying apparatus for an internal combustion engine. One of engine cylinders is provided with a suction conduit and an exhaust conduit which are separate from a main intake manifold and a main exhaust manifold which are connected to the remaining cylinders. The suction conduit is connected to a sub-carburetor, while the main intake manifold is connected to a main carburetor. The sub-carburetor includes a throttle valve mounted on a shaft on which a throttle valve in the main carburetor is mounted. The apparatus further includes fuel control means connected to the sub-carburetor for controlling supply of fuel through the separate suction conduit in response to a negative pressure prevailing in the main intake manifold. The separate exhaust conduit has a plurality of outlets opening into the main exhaust manifold. The fuel control means is operable to establish from time to time the condition under which the fluid flowing through the sub-carburetor and one cylinder into the main exhaust manifold consists only of air, of which the quantity is proportional to that of the exhaust gas delivered from the remaining cylinders.

4 Claims, 4 Drawing Figures

EXHAUST GAS PURIFYING SYSTEM FOR AN INTERNAL COMBUSTION ENGINE

This is a continuation in part of application Ser. No. 622,975 filed Oct. 16, 1975, now abandoned.

This invention relates to an exhaust gas purifying system for an internal combustion engine, and more particularly, to an apparatus for supplying air into the exhaust system of the engine to reburn the hydrocarbon and carbon monoxide in the exhaust gas.

An air pump has hitherto been used for supplying air to burn hydrocarbon and carbon monoxide in the exhaust gas from an automobile internal combustion engine or the like. The quantity of the air delivered by this pump is proportional to the rotational speed of the engine, since the rotational speed of the pump is proportional to that of the engine.

The largest quantity of air is required when the engine is operated at its highest speed. Accordingly, the air pump, which is designed to meet such maximum air requirement, delivers too much air when the engine is operated at a lower load, for example, during its idling.

It is, however, sufficient to supply only as much air into the exhaust system as can burn out hydrocarbon and carbon monoxide in the exhaust gas. If too much air is delivered, it lowers the temperature of the exhaust gas and this temperature drop exerts and adverse effect on the oxidizing reaction of hydrocarbon and carbon monoxide in the exhaust gas.

If the opening of a throttle valve in the engine is small, an excessive supply of air results in a fall of the exhaust gas temperature. On the other hand, if the throttle valve opening is large, the exhaust gas is reburnt by the air, resulting in a rise of its temperature. When the throttle valve is fully open, the exhaust gas temperature often rises to such a high level as to require the cutting off of the air supply.

Even when a very rich fuel-air mixture is supplied into the engine, for example, by actuating the choke valve during the cold seasons, the temperature of the exhaust gas sometimes rises excessively to the extent that the delivery of air into the exhaust system must often be interrupted.

When hydrocarbon and carbon monoxide are removed from exhaust gas by means of an oxidizing catalyst, it is sometimes necessary to cut off the supply of air into the exhaust system because the catalyst tends to be heated to an extremely high temperature and burned out during the combustion of the exhaust gas.

In order to avoid these various inconveniences, it is necessary to provide a changeover valve for bypassing an excessive amount of air or sending it back to the air cleaner for interrupting the supply of air into the exhaust system. Moreover, the use of any such air pump is not recommendable, because it causes a considerably great power loss of the engine and also generates noises during its operation.

It is, therefore, an object of this invention to provide an exhaust gas purifying system for an internal combustion engine which does not rely upon any air pump.

It is another object of this invention to provide an exhaust gas purifying system for an internal combustion engine which is adapted to supply the exhaust system of the engine with an optimum quantity of air for burning out hydrocarbon and carbon monoxide in the exhaust gas, with the air quantity being proportional to the operating speed and load of the engine, hence to the quantity of the exhaust gas.

It is still another object of this invention to provide an inexpensive and operationally reliable exhaust gas purifying system which can be readily installed on an existing engine without any substantial structural modification thereof.

It is a further object of this invention to provide an exhaust gas purifying system which will not cause any substantial engine power loss or noise generation.

These and other objects and features of this invention will become apparent from the following description and the accompanying drawings, in which.

Figure 1:
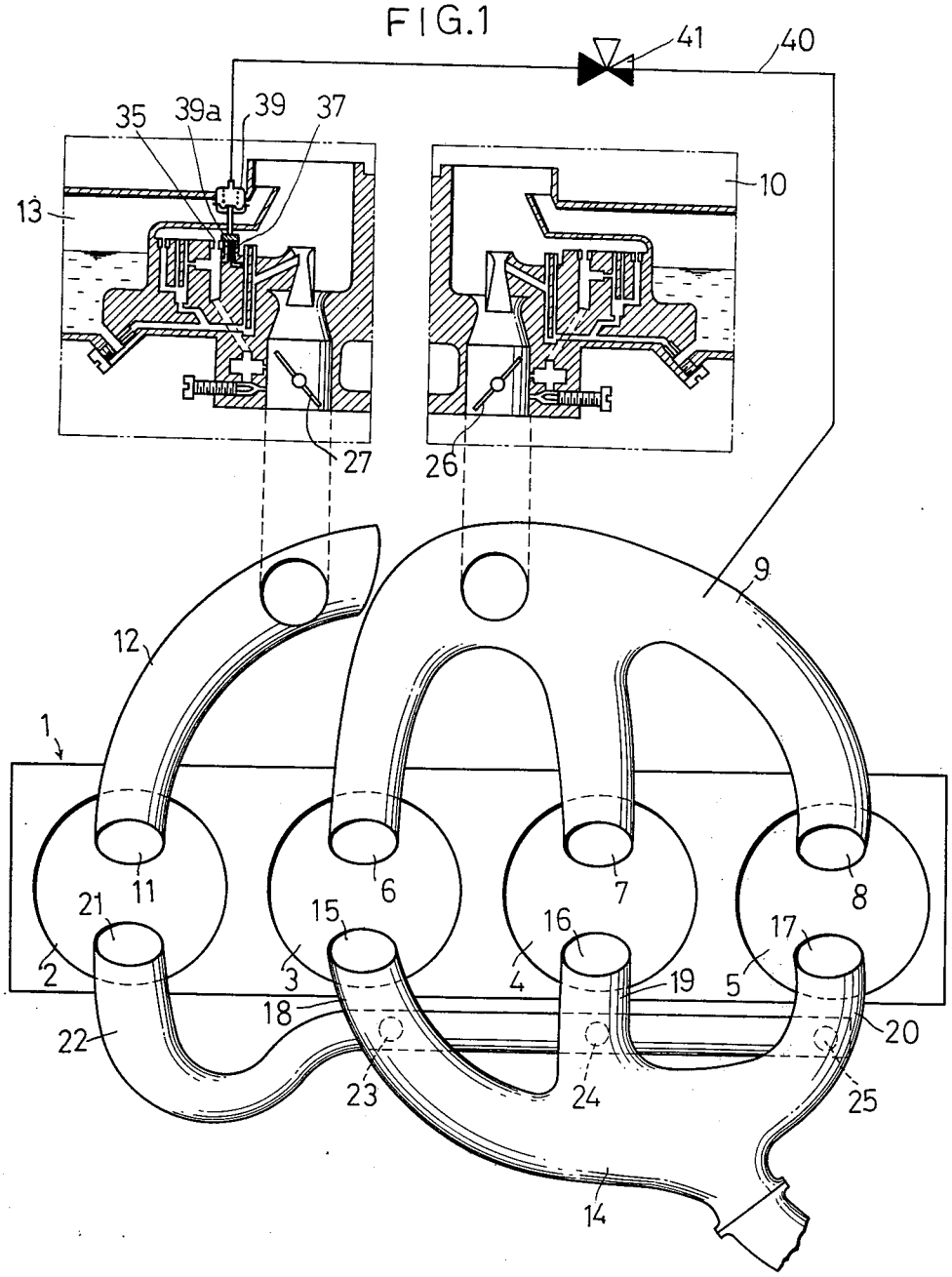
FIG. 1 is a diagrammatic view, partly in section, of a preferred embodiment of this invention.

Referring to FIG. 1 of the drawings, there is schematically shown an automobile internal combustion engine generally indicated at 1 and having a first, a second, a third and a fourth cylinder 2, 3, 4 and 5. The second, third and fourth cylinders 3, 4 and 5 have inlet ports 6, 7 and 8, respectively, which communicate with a main carburetor 10 through a main intake manifold 9. The first cylinder 2 has an inlet port 11 which communicates through an auxiliary intake conduit 12 with a sub-carburetor 13 provided with a fuel ON-OFF control device. The second, third and fourth cylinders 3, 4 and 5 have exhaust ports 15, 16 and 17, respectively, which are connected to a main exhaust manifold 14 through branch conduits 18, 19 and 20, respectively. The first cylinder 2 has an exhaust port 21 which is connected to an auxiliary exhaust manifold 22. The exhaust manifold 22 is connected to the branch conduits 18, 19 and 20 of the main exhaust manifold 14 through conduits 23, 24 and 25, respectively.

As is obvious from the foregoing description, the intake system for the first cylinder 2, which comprises the sub-suction conduit 12 and the sub-carburetor 13, is independent of the main intake system for the other cylinders 3, 4 and 5 which comprises the main intake manifold 9 and the main carburetor 10. There is no fluid communication between these two intake systems. Accordingly, under those driving conditions in which there exists no necessity of supplying air into the exhaust manifold 14, the first cylinder 2 operates in the same manner as the other cylinders 3, 4 and 5. Thus, the exhaust gas discharged from the first cylinder 2 flows through the auxiliary exhaust manifold 22 into the branch conduits 18, 19 and 20 of the main exhaust manifold 14 and is then discharged into the open atmosphere through the main exhaust manifold 14 and an exhaust pipe not shown.

On the other hand, under those driving conditions in which it is necessary to purify exhaust gas by burning any uncombusted hydrocarbon and carbon monoxide contained therein, the supply of fuel into the sub-carburetor 13 is discontinued. A piston, not shown, in the first cylinder 2, however, continues to operate with the rotation of the engine 1 and acts as a pump to force air through its intake and exhaust system 13–12–22 into the branch conduits 18, 19 and 20, in which the air burns the uncombusted hydrocarbon and carbon monoxide in the exhaust gas discharged from the second, third and fourth cylinders 3, 4 and 5. The amount of the air thus supplied through the first cylinder 2 may not only be proportional to the operating speed of the engine 1, but also to the engine load if a throttle valve 26 in the main carburetor 10 and a throttle valve 27 in the sub-carburetor 13 are mounted on a common shaft and operationally associated with each other. Accordingly, the amount of the air supplied through the first cylinder 2 is proportional to the total amount of the exhaust gas discharged from the second, third and fourth cylinders 3, 4 and 5.

Figure 2:
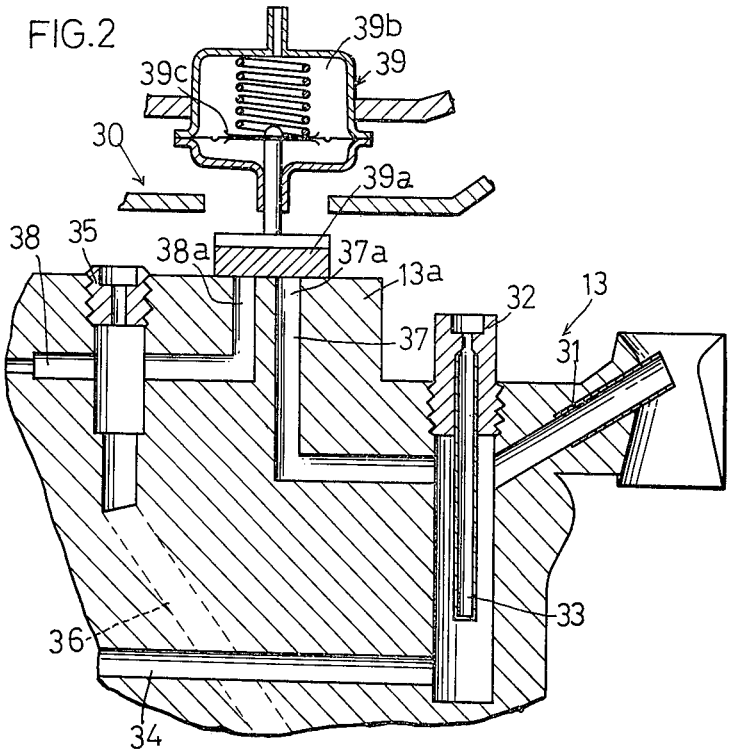
FIG. 2 is a longitudinal sectional view of the fuel control device employed in the apparatus of FIG. 1.
Figure 3:
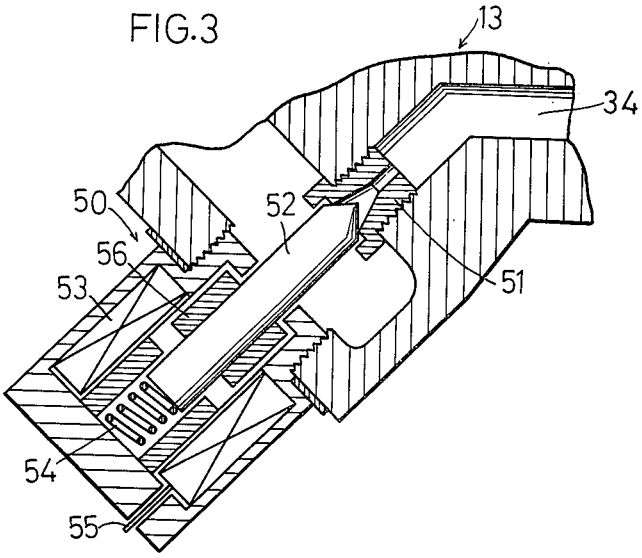
FIG. 3 is a longitudinal sectional view of another form of fuel control device.

FIGS. 2 and 3 show a couple of fuel control devices 30 and 50, respectively, for effecting the ON-OFF control of fuel supply into the exhaust conduit of the first cylinder 2.

Referring first to FIG. 2, the fuel control device 30 comprises a main nozzle 31, a main air bleed pipe 32, an emulsion tube 33, a main fuel path 34, a slow air bleed pipe 35 and a slow fuel path 36. A main cut air bleed passage 37 is provided in fluid communication with the main fuel path 34 and a slow cut air bleed passage 38 communicates with the slow fuel path 36. Each of the air bleed passages 37 and 38 has an outlet port 37*a* or 38*a* in the casing 13*a* of the sub-carburetor 13. The fuel control device 30 includes a diaphragm valve 39. The diaphragm valve 39 includes a valve member 39*a* made of rubber or like material and adapted to open and close the outlet ports 37*a* and 38*a*. The diaphragm valve 39 has a negative pressure chamber 39*b* which is connected with the main intake manifold 9 through a conduit 40 and a three-way changeover valve 41 on the conduit 40. The three-way valve 41 is operable to establish fluid communication either between the main intake manifold 9 and the negative pressure chamber 39*b* of the diaphragm valve 39 or between the negative pressure chamber 39*b* and the atmosphere. When it is desired to supply a fuel-air mixture into the first cylinder 2 through the sub-carburetor 13, the three-way valve 41 may be turned to introduce atmospheric air into the negative pressure chamber 39*b* of the diaphragm valve 39 through the conduit 40. The pressure of the negative pressure chamber 39*b* increases and the diaphragm 39*c* in the diaphragm valve 39 is displaced to cause the valve member 39*a* to close the outlet ports 37*a* and 38*a* of the main and slow cut air bleed passages 37 and 38, respectively. Thus, air is sucked into either the main air bleed pipe 32 or the slow air bleed pipe 35, depending on the operating conditions of the engine 1. This air, then, flows out into the intake system for the first cylinder 2 with fuel through the main nozzle 31 or the slow fuel path 36. The fuel is mixed with the air in the intake system for the first cylinder 2 and the resultant fuel-air mixture is supplied into the first cylinder 2.

When it is, instead, desired to introduce only air into the first cylinder 2, the three-way valve 41 may be turned in a different direction to establish fluid communication between the main intake manifold 9 and the negative pressure chamber 39*b* of the diaphragm valve 39, while it is closed against the atmosphere, in order to cause pressure reduction in the negative pressure chamber 39*b*. Consequently, the diaphragm 39*c* is displaced to move the valve member 39*a* away from the position shown in FIG. 2 and open the ports 37*a* and 38*a*, so that a considerable amount of air is sucked into the ports 37*a* and 38*a*. Accordingly, the negative pressure prevailing in the slow fuel path 36 becomes nearly zero and the supply of fuel into the intake system for the first cylinder 2 through the main and slow fuel paths 34 and 36 is discontinued, whereby only air is introduced into the first cylinder 2.

Figure 4:
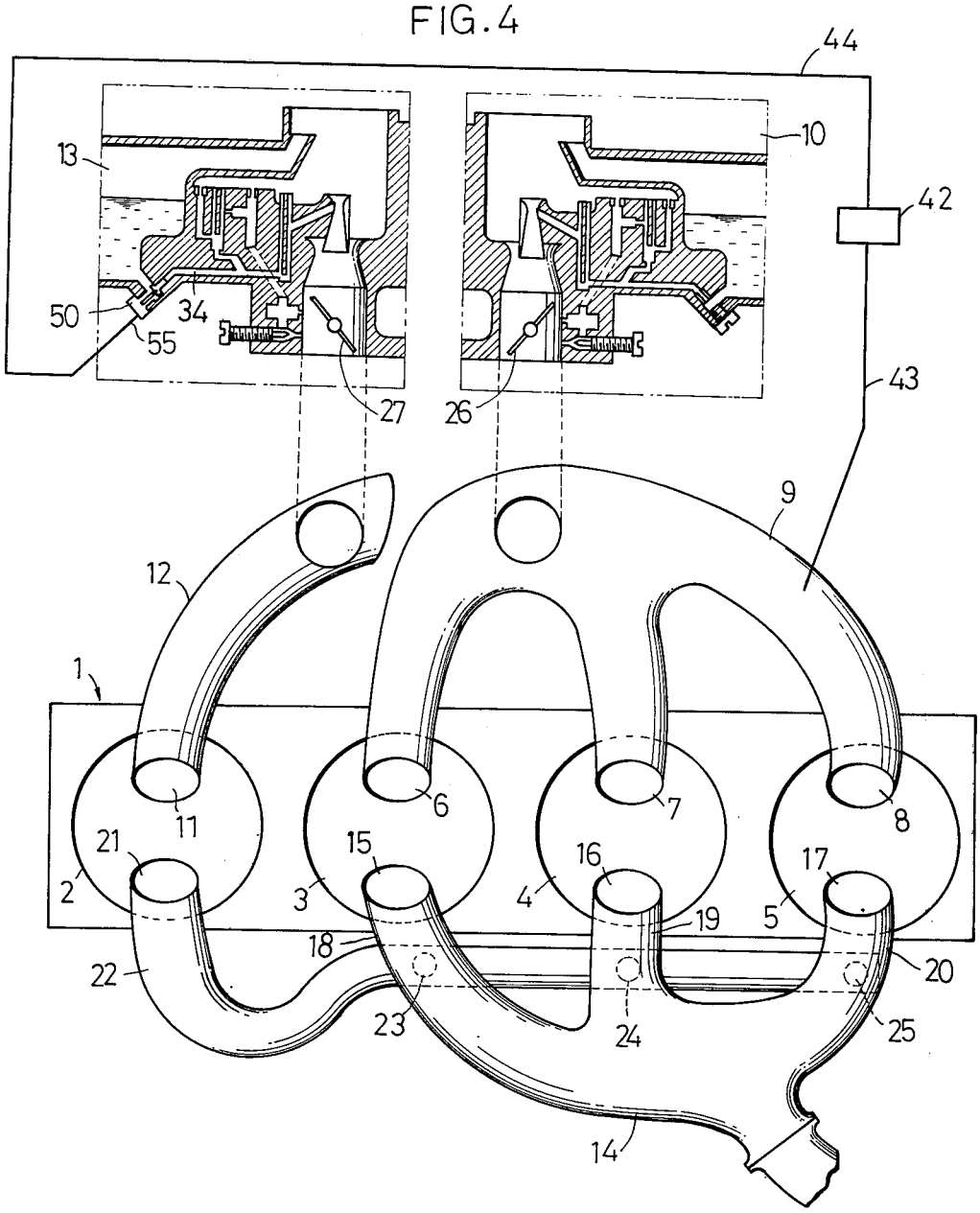
FIG. 4 is a view similar to FIG. 1 and illustrating the apparatus in which the fuel control device of FIG. 3 is employed.

Attention is now directed to FIG. 3. The fuel control device shown in FIG. 3 comprises a conventional electromagnetic valve 50. The electromagnetic valve 50 comprises a main jet 51, a valve member 52, a coil 53, a spring 54 urging the valve member 52 into its closed position, a lead wire 55 connected to the coil 53 and a movable iron core 56. The valve 50 is connected to the main fuel path 34 in the sub-carburetor 13 as shown in FIG. 4. The valve 50 is opened and closed in response to variation in the degree of negative pressure or vacuum prevailing in the main intake manifold 9, which variation depends on the operating conditions of the engine 1. For this purpose, there is provided a conventional vacuum switch 42 connected to the main intake manifold 9 by a conduit 43. The switch 42 transforms a pressure signal to an electrical signal and transmits it to the lead wire 55 of the valve 50 through a conduit 44.

When air is to be introduced into the exhaust manifold 14 through the first cylinder 2 for the purpose of burning hydrocarbon and carbon monoxide in the exhaust gas according to the device shown in FIGS. 3 and 4, the valve member 52 moves toward and closes the main jet 51, whereby the supply of fuel through the main fuel path 34 and hence, through the slow fuel path 36 will be interrupted. When the quantity of uncombusted hydrocarbon and carbon monoxide is reduced, the valve member 52 moves away from the main jet 51 to open it, whereby fuel is again supplied through the sub-carburetor 13 to the first cylinder 2 of the engine 1.

Although the fuel control devices hereinabove described with reference to FIGS. 2 and 3 are both designed for simple ON-OFF control, it will be understood that any other type of fuel control device may equally be employed, including, for example, a device adapted to selectively provide either a rich or lean fuel-air mixture or completely cut off the supply of fuel, depending on the operating conditions of the engine.

What I claim is:

1. In an internal combustion engine having a plurality of cylinders, main suction conduit means connected to a main carburetor, a throttle valve in said main carburetor and main exhaust conduit means, the improvement which comprises:

second suction conduit means separate from said main suction conduit means and opening into one of said cylinders, said main suction conduit means opening into the remaining cylinders;

a sub-carburetor connected to said second suction conduit means;

a second throttle valve provided in said sub-carburetor and mounted on a shaft on which said throttle valve in said main carburetor is mounted;

second exhaust conduit means having one end connected to said one cylinder and another end connected to said main exhaust conduit means connected to said remaining cylinders; and means connected between said sub-carburetor and said main suction conduit means and responsive to a negative pressure prevailing in said main suction conduit means for controlling supply of fuel through said second suction conduit means, whereby fluid flow through said one cylinder into said main exhaust conduit means is restricted to atmospheric air.

2. The invention as defined in claim 1, wherein said sub-carburetor has a main and a slow cut air bleed passage, and wherein said fuel control means comprises:

a diaphragm valve connected to said sub-carburetor and having a valve member connected to a diaphragm and movable to and away from said main and slow cut air bleed passages and a negative pressure chamber defined by said diaphragm;

a conduit connected between said main suction conduit means and said negative pressure chamber; and a three-way valve provided on said conduit and operable to selectively establish fluid communication either between said main suction conduit means and said negative pressure chamber or between said negative pressure chamber and its exterior under atmospheric pressure, whereby said valve member selectively opens and closes said main and slow cut air bleed passages.

3. The invention as defined in claim 1, wherein said sub-carburetor has a main and a slow fuel path, and wherein said fuel control means comprises:

an electromagnetic valve connected to said sub-carburetor and having a valve member movable responsive to a negative pressure prevailing in said main suction conduit means for selectively opening and closing said main and slow fuel paths.

4. The invention as defined in claim 1, wherein said main exhaust conduit means includes a plurality of conduits each connected to one of said remaining cylinders, and wherein said second exhaust conduit means includes at said other end thereof a plurality of conduits each connected to one of said conduits of said main exhaust conduit means.

* * * * *